United States Patent [19]

Forbes, Jr.

[11] 4,113,086

[45] Sep. 12, 1978

[54] END LOADED CARTON WITH AUTOMATIC HEADER

[75] Inventor: Hampton E. Forbes, Jr., Wilmington, Del.

[73] Assignee: Westvaco Corporation, New York, N.Y.

[21] Appl. No.: 842,261

[22] Filed: Oct. 14, 1977

[51] Int. Cl.[2] ..... B65D 5/48; B65D 5/50

[52] U.S. Cl. ..... 206/45.14; 206/45.31; 229/15; 229/37 R

[58] Field of Search ..... 229/15, 27, 37 R; 206/45.14, 45.31

[56] References Cited

U.S. PATENT DOCUMENTS

| | | | |
|---|---|---|---|
| 2,617,578 | 11/1952 | Fischer | 229/27 |
| 2,732,123 | 1/1956 | Bolding | 229/27 |
| 2,857,881 | 10/1958 | Beebe et al. | 229/27 |
| 2,987,235 | 6/1961 | McCallum | 229/27 |
| 3,158,259 | 11/1964 | Pantalone | 206/45.14 |
| 3,575,286 | 4/1971 | Rosenburg, Jr. | 229/27 |
| 3,734,284 | 5/1973 | Schillinger | 206/45.14 |

FOREIGN PATENT DOCUMENTS

| | | | |
|---|---|---|---|
| 1,457,291 | 12/1976 | United Kingdom | 206/45.31 |

*Primary Examiner*—William Price
*Assistant Examiner*—Bruce H. Bernstein

[57] ABSTRACT

An end loaded display carton is formed from a cut and scored blank of paperboard or the like that is preglued and shipped in a generally flat folded condition. The carton, when squared, is of essentially parallelopiped configuration with spaced front and rear walls connected by two outer side walls, and includes a central compartment for receiving a product and a header member at one end thereof. The central compartment is defined by a pair of inner side wall panels that are spaced inboard of and parallel to the outer side walls and which extend for substantially the entire length of the carton. When the carton is squared from its generally flat folded condition to its product receiving parallelopiped condition, the header member at one end thereof is automatically oriented over the central compartment portion of the carton.

9 Claims, 7 Drawing Figures

END LOADED CARTON WITH AUTOMATIC HEADER

BACKGROUND OF INVENTION

The present invention relates generally to an improvement in display type cartons of the end loaded type, and more particularly to display cartons which are adapted to protectively contain and display products, especially those of a frangible nature.

Cartons of the above noted type are generally loaded through one end thereof and thus require product supporting members or other means at the opposite end for stopping, positioning and guiding the product as it is loaded into the carton. In addition, the support member or other means generally acts as a positioning element for the packaged product. To achieve the above purposes, the carton of the present invention has incorporated as an integral part of the blank structure a header member that automatically becomes oriented in transverse relation to the inner compartment thereof when the carton is squared for loading.

THE PRIOR ART

Cartons which include various devices and constructions for supporting, positioning and aiding in the loading of products therein are disclosed in the following prior U.S. Pat. Nos.:

2,854,181 — (229-27)
2,937,743 — (206-45.14)
3,158,259 — (206-45.14)
3,360,117 — (206-45.14)
3,575,286 — (206-45.14)
3,684,085 — (206-45.14)

In each of the above noted patents, the means disclosed for retaining, supporting or positioning the packaged product in a carton generally requires an extra folding or gluing step. For instance, in U.S. Pat. No. 3,158,259, the header consists of two panels which are adhered together and then moved into position to form the roof of the carton when one end is closed. Similarly, the panels of the carton in U.S. Pat. No. 3,360,117, which serve to position and retain the product must be independently folded into their respective positions as separate steps in the packaging process. Meanwhile, the header member of U.S. Pat. No. 3,575,286 is also a two part element that must be glued and urged into position when an end of the carton is closed. And finally, the product retaining panels of the carton disclosed in U.S. Pat. No. 3,684,085 require an initial prefolding step and then a second step where one of the panels must be held aside, when the product is loaded into the carton. The two known exceptions to the above can be found in U.S. Pat. Nos. 2,854,181 and 2,937,743. In the former, a compartmented carton is disclosed which has incorporated therein a reinforcing panel to provide support for a packaged product, which support member is aligned with the compartment it bisects. In the latter, an article supporting flap is provided on a carton, which flap is dependent on its contact with a closed end of the carton to provide its supporting function. Thus it may be seen that while the prior art discloses various schemes for retaining, supporting and positioning products within compartments in display packages, none disclose a header member as described herein, which becomes automatically and transversely positioned over one end of an inner compartment when the carton is squared for loading.

SUMMARY OF INVENTION

The present invention relates principally to an improvement in display type cartons and more particularly has for its principal purpose the provision of an end loaded display carton with an integral, automatically oriented header member. The carton is cut and scored from a single blank of paperboard or the like and is formed into a configuration comprising an outer carton with an integral inner compartment for accepting the packaged product. The carton is intended to package generally elongated products such as collapsible tubes for toothpaste, cosmetics and the like in such a manner that the products are isolated in a protected environment. Moreover, because of the location, arrangement and function of the improved header member, the loading and positioning of the packaged product in the inner compartment thereof is enhanced.

The present invention is carried out by including on the carton blank structure at least one additional flap member attached to an end of one of the inner side walls that form the inner compartment of the carton. If desired, however, additional flaps can be foldably attached to the ends of both of the inner side walls of the carton, in which case they would tend to overlap one another, as long as the overall geometrical dimensions of the carton are taken into account. In general, the additional flap or flap members are foldably attached to the carton blank in a position that would normally produce scrap material. Thus, the present invention not only provides an improvement to known display type cartons, but utilizes what has heretofore been considered waste material to accomplish the result.

IN THE DRAWINGS

FIG. 1(*a*) is a fragmentary plan view showing a portion of a modified blank structure according to FIG. 1;

DETAILED DESCRIPTION

Figure 1:
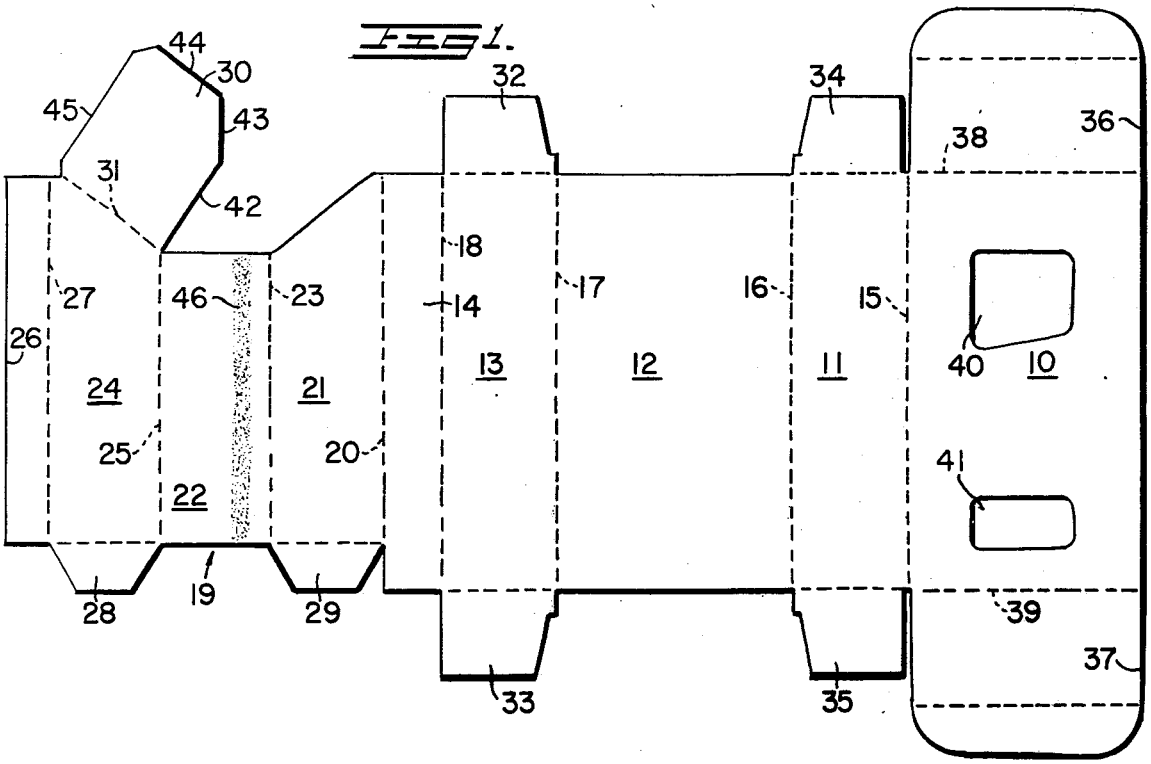
FIG. 1 is a plan view of a typical blank structure for constructing the carton of the present invention.
Figure 1A:
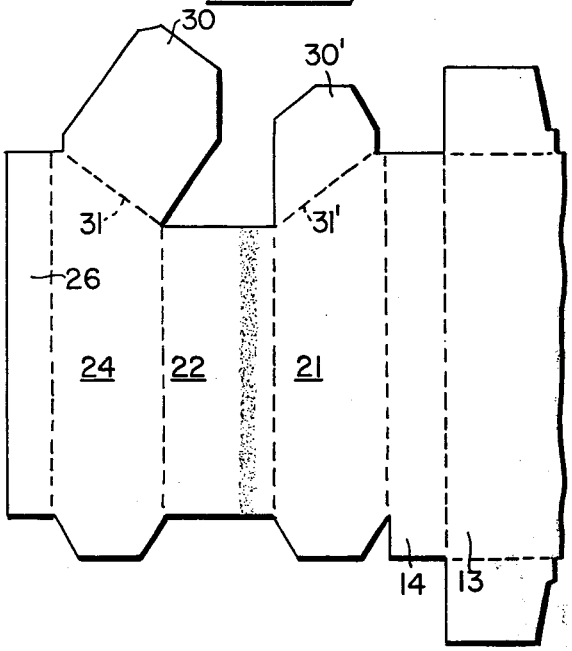

Referring now to FIG. 1 of the drawing, a typical carton blank will be seen to comprise a front panel 10, a first side wall 11, a back panel 12, a second side wall 13 and a closure or glue flap 14 connected together by scored fold lines 15, 16, 17 and 18. These panels, with the end closure flaps 36, 37 connected to front panel 10 along scored fold lines 38, 39 respectively, constitute the outer structure of the carton of the present invention. At one side of the blank, and connected to glue flap 14 along fold line 20, is an extension 19 which forms the inner compartment of the carton and includes the automatically oriented integral header member 30 which represents the improvement disclosed in the present invention.

Extension 19 forms the product receiving inner compartment of the carton and comprises a first inner side panel 21, a back panel 22, a second inner side panel 24 and a closure flap or glue flap 26. These elements of the carton are foldably connected to one another along the score lines 23, 25 and 27. At one end of the first and second inner side panels 21, 24, a pair of V-shaped extensions 28, 29 are provided which serve in the squared condition of the carton to guide the product as it is loaded into the carton from the open end thereof. Meanwhile, at the opposite end of the first and second inner side panels 21, 24 there is provided at least one header panel member 30, shown in FIG. 1 as being connected to panel 24 along scored fold line 31. Fold line 31 is preferably arranged on a diagonal at an interior angle of at least about 30° with the horizontal in order to achieve the automatic orientation of the header panel 30 when the carton is squared. The header panel 30 in FIG. 1 comprises a flap member with spaced apart and parallel side edges 42, 45 and an outer edge formed by the intersecting cuts at 43, 44. The width of panel 30 defined by the side edges 42, 45 is preferably greater than the width of either the attached inner side panel 24 or the back panel 22 in order to produce a structure with an angular orientation of about 30° when the carton is squared. The length of panel 30 defined by the distance between outer edge 44 and fold line 31 cannot exceed the combined width of back panel 22 and glue flap 14, and it should be at least slightly greater than the width of back panel 22 when only one header member is provided for the carton. When a pair of header members 30 and 30' are provided, as shown in FIG. 1(*a*), the length of the panel 30 can be less since it is ultimately overlapped by the second header panel 30' when the carton is squared and one end is closed. The header panel 30 in FIG. 1 is shown as being cut along an edge 43. The cut at 43 is applied so as to prevent the panel 30 from interfering with the glue application at 46 to back panel 22. Normally the glue application 46 is applied to the blank in flattened condition from a glue wheel as the blank is passed over or under the wheel. If the cut at 43 in panel 30 was omitted, adhesive would also be applied to the panel itself. Of course, where the glue is applied to the blank with pads, such as on a Staude machine, the header panel 30 would not have to be cut at 43.

Figure 2:
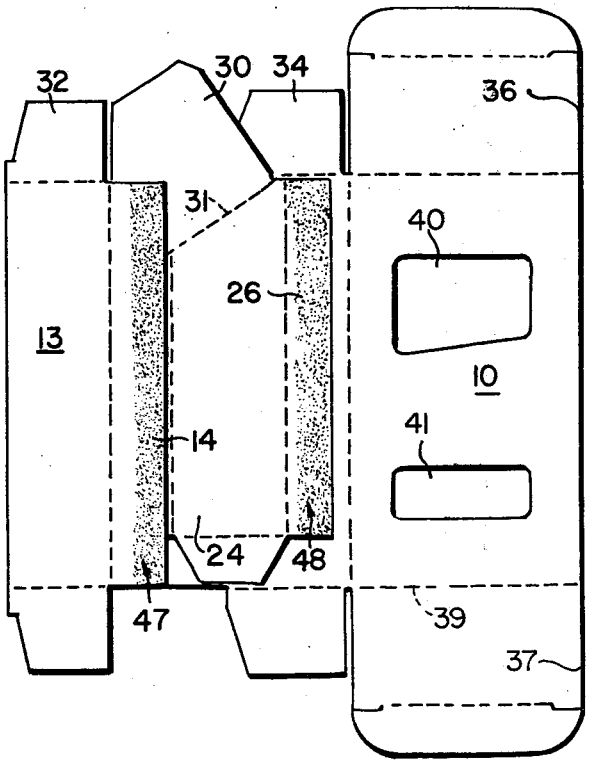
FIG. 2 is a fragmentary plan view of the blank structure of FIG. 1 prior to the last folding step in constructing the carton.

After application of adhesive at 46 as shown in FIG. 1, the blank is folded as shown in FIG. 2 to adhere back panel 22 to back wall 12. This step is accomplished by first folding the extension 19 of the blank shown in FIG. 1 from left to right about score line 20, then folding the back panel 22 and inner side wall 24 reversely from right to left about score line 21, and finally folding the prefolded extension 19 from left to right about score line 17 to bring the adhesive applied side of back panel 22 into contact with the inside of back wall 12. The three folding steps described above place the blank in the condition shown in FIG. 2 with the preapplied adhesive applications 47, 48 to panels 14 and 26 turned up. In the condition shown in FIG. 2, the carton blank is ready for its final fold when front wall 10 is folded from right to left about score line 15 to adhere panels 14 and 26 to the inside of wall 10. The fully formed carton is shown in its flat, collapsed condition in FIG. 3.

The forming of the carton as described hereinbefore is substantially conventional, and is done mechanically on suitably programmed gluing and folding machinery. The application of compressive pressure to the folded blank after each fold tends to aid the set of the adhesive and maintain the carton in its preferred collapsed condition for shipment to the ultimate user. When the user of the cartons feeds the semi-erected cartons into the desired carton loading and closing apparatus, the improvement in the present invention comes into effect.

Figure 3:
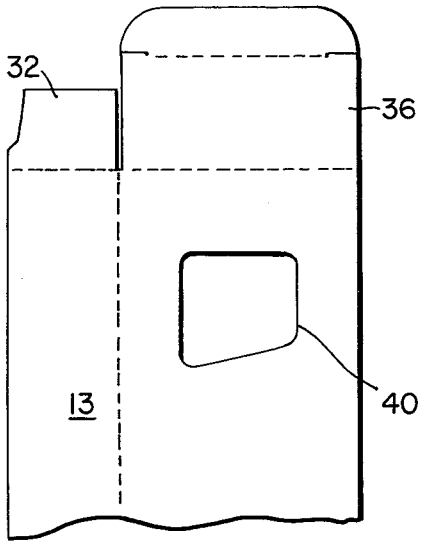
FIG. 3 is a fragmentary plan view showing the blank structure completely folded but in collapsed condition with the front of the carton facing up.
Figure 4:
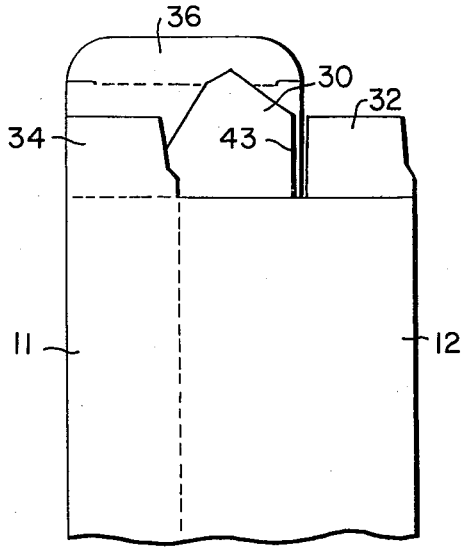
FIG. 4 is a view substantially as shown in FIG. 3 with the back of the carton facing up.
Figure 5:
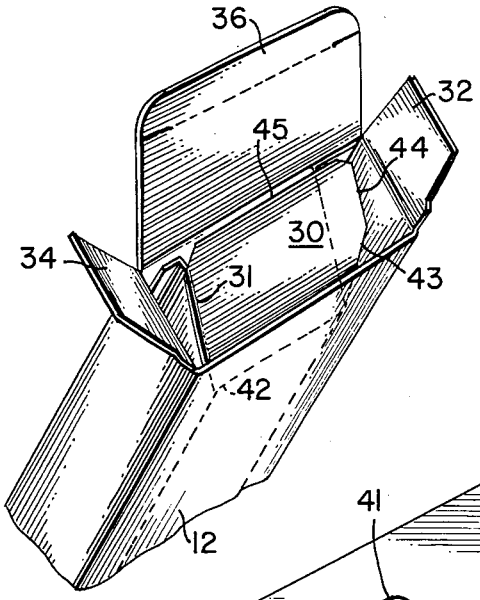
FIG. 5 is a partial perspective view of the erected carton after squaring up illustrating the automatic orientation of the header member over the end of the central compartment of the carton; and, FIG. 6 is a perspective view of the squared and closed but empty carton.

FIG. 4 illustrates the glued and collapsed carton of FIG. 3 turned back side up. In this condition, the header member can be seen lying intermediate the end flaps 32, 34 and in front of the end closure flap 36. With the carton disposed as shown in FIG. 4, squaring of the side walls to the condition shown in FIG. 5 is accomplished by urging the extreme outside edges toward one another. This action brings the outer side walls 11 and 13 into a position perpendicular to the back and front walls 10, 12. Meanwhile, the squaring step also urges the parallel and spaced apart inner side wall panels 21, 24 into a condition perpendicular to the front and back walls 10, 12. Simultaneously, the header panel 30 is automatically oriented as shown in FIG. 5 over the inner compartment formed by inner side wall panels 21, 24 and the front and back walls 10, 12. The orientation of the header member 30 is accomplished when the lower edge thereof 42 abuts against the inside of back wall 12, as the carton is being squared, to produce a concomittant rotation of the header about fold line 31 and into position against the ends of the inner side wall panels 21, 24. Depending upon the length of the header member 30, it will then extend at least across the end of the inner compartment of the carton and perhaps even all the way to the outer side wall 13. Of course, where two header members 30, 30' are used, as shown in FIG. 1(*a*), the portion 30 thereof at least partially covers the inner compartment area while the portion 30' is manually urged down and over the previously automatically positioned panel. Subsequent to the squaring of the carton and the automatic positioning of the header member 30, the end of the carton is closed, either manually or by appropriate carton folding machinery, when dust flaps 32, 34 are folded down and held in place by the end flap 36 and its integral tuck flap.

Figure 6:
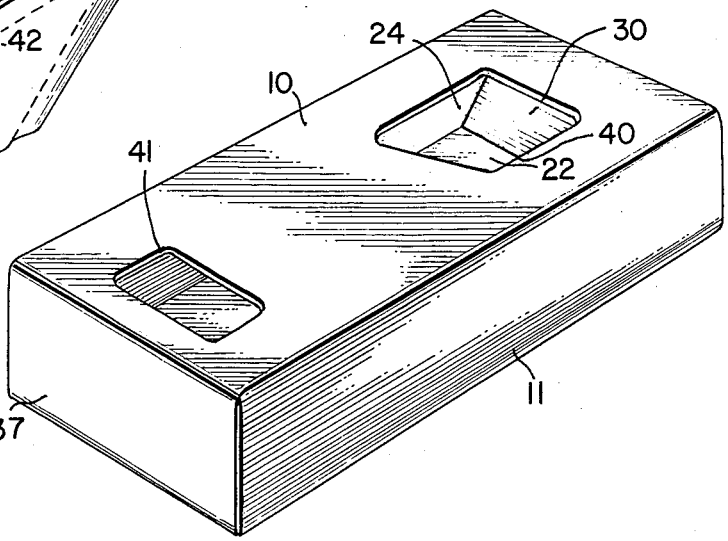

After one end of the carton is closed as described above, it is ready to be filled. This step is accomplished through the remaining open end of the carton, wherein the extension 28, 29 on inner side walls 24, 21 serve to guide the product into the inner compartment, and, the header member 30 stops and positions the product at the opposite end. FIG. 6 illustrates the completely closed carton without a product for clarity only.

Accordingly, this specification and the accompanying drawing describe and illustrate a preferred embodiment and at least one modified form of an improvement to end loaded display cartons. It is to be understood, however, that the disclosure herein is susceptible to changes and adaptations for specific products, within the knowledge of those skilled in the art, without deviating from the scope of the invention as defined in the appended claims.

I claim:

1. An end loaded carton of generally parallelopiped configuration, formed from a single blank of paperboard or the like comprising, spaced outer front and rear walls separated from one another by a pair of outer side walls, end closure flaps for each end of the carton, and an inner product receiving compartment, said inner compartment comprising a pair of inner side wall panels spaced apart and inboard of said outer side walls and adhered to the said outer front and rear walls, the improvement comprising a first inner compartment header panel foldably attached to an end of one of said inner side wall panels along a diagonally oriented score line and adapted for automatic orientation over the end of said inner compartment when said carton is squared for loading, by the initial abutment of a lower edge of said header panel against the inside of said rear wall, said abutment causing the concomitant rotation of said header panel about its diagonal fold line.

2. The carton of claim 1 wherein the width of said first header panel is greater than the width of its attached inner side wall panel.

3. The carton of claim 2 wherein the length of said first header panel is equal at least to the space between said inner sidewall panels.

4. The carton of claim 3 wherein said first header panel abuts and lies in contact with the end of the other of said inner side wall panels when the carton is squared for loading.

5. The carton of claim 1 wherein a second inner compartment header panel is foldably attached to the end of the other inner compartment side wall opposite said first header panel.

6. The carton of claim 5 wherein said first and second header panels each have a width greater than the width of their attached inner side wall panels.

7. The carton of claim 6 wherein the lengths of said first and second header panels is sufficient to overlap one another when the carton is squared for loading.

8. A carton assembly for the end loading of products in a centrally located inner compartment thereof comprising, a one piece blank provided with a front wall having end closure flaps attached at each end thereof, and extending from one side thereof and successively joined thereto by parallel substantially vertical fold lines, (a) a first outer side wall;
(b) a rear wall panel;
(c) a second outer side wall;
(d) a first glue flap;
(e) a first inner compartment side wall;
(f) an inner compartment back panel;
(g) a second inner compartment side wall;
(h) a second glue flap; and,
(i) a first header panel foldably attached to one upper end of said second inner compartment side wall along a diagonally oriented fold line at an interior angle of at least about 30° with the horizontal and adapted for automatic orientation over the end of said inner compartment when said carton is squared for loading by the initial abutment of a lower edge of said header panel against the inside of said rear wall, said abutment causing the concomitant rotation of said header panel about its diagonal fold line.

9. The carton assembly of claim 8 wherein a second header panel is foldably attached to the upper end of said first inner compartment side wall along a diagonally oriented fold line at an interior angle of at least about 30° with the horizontal.

* * * * *